United States Patent [19]

Heykants

[11] 4,243,207

[45] Jan. 6, 1981

[54] FREE STANDING PORTABLE STAIRWAY RAILING DEVICE

[76] Inventor: Lambertus Heykants, Rte. 1, Belmond, Iowa 50421

[21] Appl. No.: 962,331

[22] Filed: Nov. 20, 1978

[51] Int. Cl.[2] ..... E04H 17/00

[52] U.S. Cl. ..... 256/64; 256/1

[58] Field of Search ..... 52/184, 183; 256/1, 256/59, 24, 67, 65, 69, 64; 182/106

[56] References Cited

U.S. PATENT DOCUMENTS

| | | | |
|---|---|---|---|
| 3,693,754 | 9/1972 | Butler | 182/115 X |
| 3,808,757 | 5/1974 | Greenwood | 256/59 X |
| 3,912,298 | 10/1975 | Humphrey | 182/115 X |
| 4,074,893 | 2/1978 | Coltrin | 256/69 X |

*Primary Examiner*—Andrew V. Kundrat

*Attorney, Agent, or Firm*—Zarley, McKee, Thomte, Voorhees & Sease

[57] ABSTRACT

A freestanding portable stairway railing device is disclosed comprising a frame structure having forward and rearward ends, a first support foot adapted to engage a stairway surface and secured to the rearward end of the frame structure, a second support foot adapted to engage the stairway surface and detachably secured to the frame structure in spaced apart relation to the first support foot so that the frame structure is supported in a freestanding upright disposition on the stairway surface, and a hand rail is attached to the upper portion of the frame structure. The attachment means for detachably securing the second support foot to the frame structure allows selective variance of the vertical distance between the frame structure and the stepping surface. The attachment means also allows selective variance of the distance between the first support foot and the second support foot. A second identical railing device may be disposed in opposing spaced apart parallel alignment to provide a railing on each side of the stairway. A support brace rigidly connects the first railing device to the second railing device.

12 Claims, 4 Drawing Figures

FREE STANDING PORTABLE STAIRWAY RAILING DEVICE

BACKGROUND OF THE INVENTION

This invention relates to stairway railings and more particularly to a freestanding portable stairway railing device. Prior railings were neither truly portable nor freestanding. The prior devices required actual connection to the stairway and were dependent upon the width of the stairway to determine the distance between the railings. Assembly and disassembly of prior devices required tools and some disfigurement to the stairway. Also, the prior stairway devices did not facilitate the ascension of a person not having the full use of both legs and supporting themselves in part with their arms, such as someone on crutches.

SUMMARY OF THE INVENTION

A freestanding portable stairway railing device is disclosed that can be utilized either singly or in spaced apart parallel pairs with each singular device comprising a frame structure having forward and rearward ends, a first support foot adapted to engage a stairway surface and being secured to the rearward end of the frame structure, a second support foot adapted to engage the stairway surface and detachably secured in spaced apart relation to the first foot so as to support the frame structure in a freestanding upright disposition on the stairway surface, and a hand rail attached to the upper portion of the frame structure. The second support foot is detachably secured to the frame structure so as to allow vertical adjustment and selection of the height of the frame structure above the stepping surface. The detachable securement of the second support foot to the frame structure also allows selective adjustment of the distance between the first support foot and the second support foot. The hand rail has a plurality of vertically stepped support surfaces. When combining two such devices in parallel relationship, a support brace extends between each frame structure to add additional stability.

It is a principal object of this invention to provide a freestanding portable stairway railing device.

It is a further object of this invention to provide an improved portable stairway railing device.

A still further object of the invention is to provide a freestanding portable stairway railing device that securely engages a stairway without attachment to the stairway or disfigurement of the stairway.

A still further object of the invention is to provide a freestanding portable stairway railing device that may be utilized irrespective of the width of the particular stairway.

A still further object of the invention is to provide a freestanding portable stairway railing device that can be utilized on stairways of various depths and inclines.

A still further object of the invention is to provide a freestanding portable stairway device that can be assembled and disassembled by hand without tools.

A still further object of the invention is to provide a freestanding portable stairway railing device that can be utilized by persons not having the use of both legs.

A still further object of the invention is to provide a freestanding portable stairway railing device that is economical to manufacture, durable in use and refined in appearance.

DESCRIPTION OF THE PREFERRED EMBODIMENT

Figure 1:
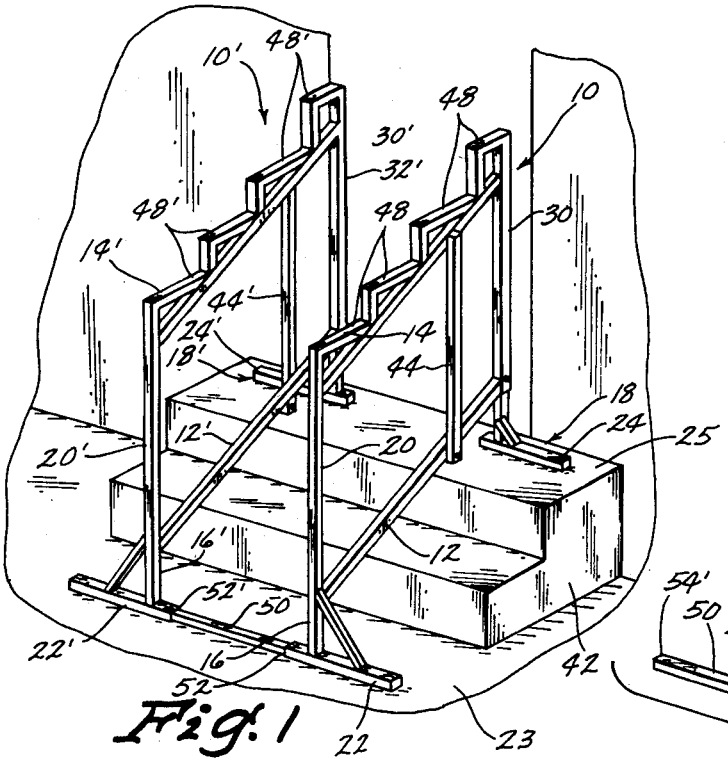
FIG. 1 is a perspective view of this invention.
Figure 2:
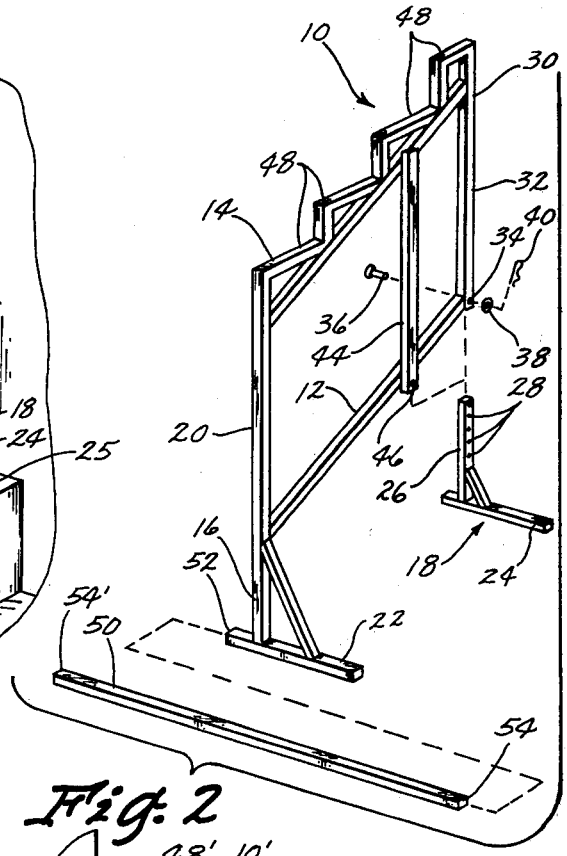
FIG. 2 is a partially exploded perspective view of the invention.
Figure 3:
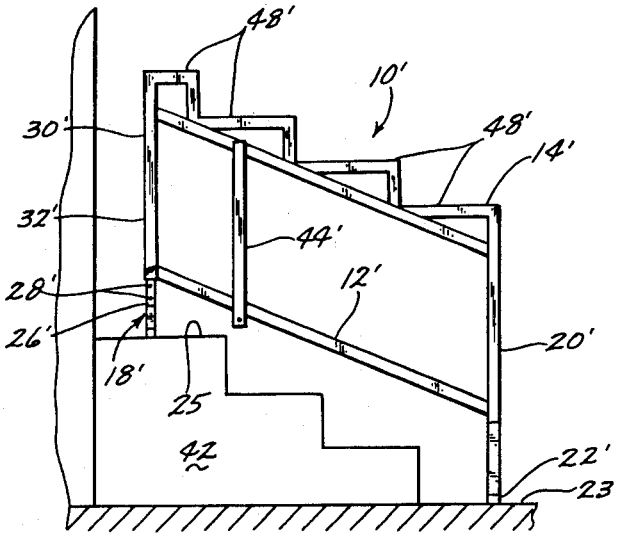
FIG. 3 is an elevated side view of the invention.

The numeral 10 generally refers to the freestanding portable stairway railing device of this invention shown in exploded view in FIG. 2. FIG. 1 shows a pair of stairway railing devices 10 and 10' oppositely disposed in parallel relationship on a stairway stepping surface. Because railing devices 10 and 10' are similar, only device 10 will be described in detail and, when necessary for purposes of explanation, similar structure in device 10' will be designated by the same numeral with a prime, i.e., "'" designation.

Stairway railing device 10 generally comprises a frame structure 12, a hand rail 14, a rear support foot 16, and a forward support foot 18. It should be noted that the terms forward and rearward are used only for purposes of explanation and are not intended to limit or particularly define the structural aspects of the present invention. In this regard, rear support foot 16 is securely attached to the rearward end 20 of frame structure 12 and has an elongation bar element 22 extending transversely with respect to frame structure 12 and intended to engage a stairway surface 23.

Forward support foot 18 also has an elongated bar element 24 adapted to engage a stairway surface 25. An upstanding post 26 is securely attached to bar element 18 and contains a plurality of parallel, vertically aligned pin receiving apertures 28 (FIG. 2). The forward end 30 of frame 12 has a sleeve member 32 such that post 26 is slidably received within sleeve member 32. Sleeve member 32 has a stop pin aperture 34 extending therethrough and adapted to align with a selected one of the pin receiving apertures 28 when post 26 is received by sleeve member 32. Stop pin 36 is received through stop pin aperture 34 of sleeve 32 and a selected one of the pin receiving apertures 28 of post 26 and held in place by washer 38 and cotter pin 40 through an aperture (not shown) in stop pin 36 in conventional fashion. The vertical alignment of pin receiving apertures 28 thus allows selective variance of the vertical position of frame 12 above the stairway generally referred to as 42 and shown in FIG. 1. The height adjustment is easily accomplished by stop pin 36 and the respective apertures without the need of tools and provides a height adjustment to adapt the stairway railing device for varying stairway slopes and stairway depths.

When forward support foot 18 is secured to frame 12 by sleeve member 32 as shown in FIG. 1, bar elements 22 and 24 are in spaced apart, generally parallel, disposition to each other and transverse the vertical plane of frame 12 to support frame 12 in a freestanding upright disposition on a stairway surface. A second sleeve member 44 is securely attached to frame 12 and is also adapted to slidably receive post 26. Sleeve member 44 has a stop pin aperture 46 therethrough to receive stop pin 36 in a manner identical with sleeve 32. Sleeve 44 allows the distance between rear support foot 16 and forward support foot 18 to be varied to accommodate stairways of various stairway depths, and to some degree stairway slopes, in order to provide optimum freestanding stability.

Figure 4:
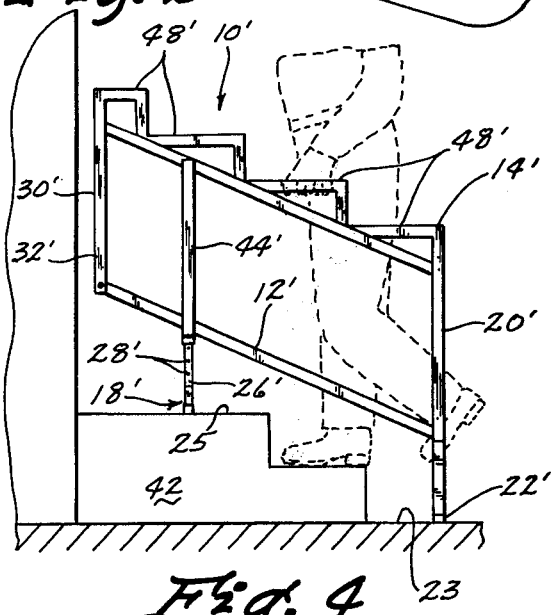
FIG. 4 is an elevated side view of the invention similar to FIG. 3 with actual use being illustrated in phantom.

Hand rail 14 is securely attached to the top portion of frame 12 and comprises a plurality of vertically stepped support surfaces 48. The vertically stepped support surfaces 48 allow a person not having the use of both legs to ascend a stairway when a pair of stairway railing devices 10, 10' are arranged as shown in FIG. 1. FIG. 4 illustrates in phantom such a utilization of the device.

When stairway railing devices 10 and 10' are utilized as a pair as shown in FIG. 1, support brace 50 rigidly connects frame 12 to frame 12' to provide added stability. Bar element 22 contains a channel (not shown) at the inner end 52 thereof to receive end 54 of support brace 50. In a likewise fashion, bar 22' has a channel (not shown) at the inner end 52' thereof to slidably receive end 54' of brace 50. FIG. 2 illustrates in exploded view how the connection of end 54 to bar element 22 is to be made. Thus, brace 50 provides added freestanding stability and holds frames 12 and 12' in spaced apart parallel alignment.

As can be seen, portable stairway railing device 10 is freestanding so as to provide railing support when ascending a stairway. Two handed railing support is attained by using a pair of such railing devices 10 and 10' as shown in FIG. 1. Additional freestanding support is provided by support brace 50 such that the device can be safely utilized by one having leg infirmities.

As described above, the adjustment and assembly of the device is simple and can be accomplished without the need of tools. The device is preferably constructed of tubular or hollow brace elements to provide strength, yet minimize the weight. The stairway railing device is compatible with varying sizes of stairways and operatively attaches thereto by freestanding support principles rather than detachment means secured to the stairway. Thus, the stairway railing device is portable in the absolute sense, and does not deface the stairway to which it is operatively attached.

Because of the stairway device is easily assembled and disassembled, it can be transported and assembled easily for even the most temporary situations.

It should be noted that the use of stairway railing device 10 and 10' is in no way limited by the width of the particular stairway. Thus, the distance between device 10 and 10' can be selected so as to provide substantial support when ascending the stairs irrespective of the width of the stairs. In this regard, it is necessary that the devices 10 and 10' be relatively close together if one is utilizing his arms to a substantial degree to ascend the stairway.

Thus, it can be seen that this device accomplishes at least all of its stated objectives.

What is claimed is:

1. A freestanding portable stairway railing device independent of steps or platform and adapted to placed thereon or removed as an independent unit comprising, a first frame means having forward and rearward ends, and upper and lower portions, a first support foot adapted to engage a stairway surface, said first support foot being secured to said rearward end of said first frame means, a second support foot adapted to engage said stairway surface at a higher level than said first support foot, attachment means to detachably secure said second support foot to said lower portion of said first frame means in spaced apart relation to said first support foot, and the combined surface area of both feet being adequate so that said first and second support feet support said first frame means in a freestanding upright disposition on said stairway surface, and a first hand rail means attached to said upper portion of said frist frame means.

2. The device of claim 1 wherein said attachment means comprises means for selectively securing said first frame means to said second foot support at selective vertical positions above said stairway surface.

3. The device of claim 2 wherein said first frame means has a sleeve member with a stop pin aperture therethrough and said second foot support has a post element with a plurality of pin receiving apertures, said post element being slidably received by said sleeve member so that said stop pin aperture of said sleeve member aligns with a selected one of said plurality of pin receiving apertures of said post element, and a stop pin is slidably received by said stop pin aperture and said selected one of said plurality of pin receiving apertures.

4. The device of claim 1 wherein said attachment means comprises means for selectively securing said second foot support element to said first frame means at selective predetermined distances from said first foot support element.

5. The device of claim 4 wherein said first frame means has first and second spaced apart sleeve members, each said sleeve member in spaced apart relation to said rearward end and each having a stop pin aperture therethrough, said second foot support having a post element with at least one pin receiving aperture therethrough, said post element being selectively, alternatively slidably received by one of said sleeve members, and a stop pin for slidable reception by said stop pin aperture of said selective one of said sleeve members and said pin receiving aperture of said post element to secure said post element to said selective one of said sleeve members.

6. The device of claim 1 wherein said first hand rail means comprises a plurality of vertically stepped surfaces.

7. The device of claim 1 wherein said first and second foot supports each comprise an elongated bar for engagement with said stepping surface and transversely disposed with respect to said first frame means.

8. The device of claim 7 wherein each said bar is generally perpendicular to the vertical plane of said frame means.

9. The device of claim 1 further comprising a second frame means having forward and rearward ends, and upper and lower portions, a third support foot adapted to engage a stairway surface, said third support foot being secured to said rearward end of said second frame means, a fourth support foot adapted to engage said stairway surface, at a higher level than said third support foot, second attachment means to detachably secure said fourth support foot to said lower portion of said second frame means in spaced apart relation to said third support foot so that said third and fourth support feet support said second frame means in a freestanding upright disposition on said stairway surface, in opposing spaced apart, parallel alignment to said first frame means, and a second hand rail means attached to said upper portion of said second frame means.

10. The device of claim 9 wherein a support means rigidly connects said first frame means to said second frame means to hold said first and second frame means in opposing, spaced apart, parallel alignment.

11. The device of claim 10 wherein said support means is generally perpendicular to said first and second frame means and is adapted to abut said stairway surface.

12. The device of claim 10 wherein said first support foot has an elongated first bar element for engagement with said stepping surface and transversely disposed with respect to said first frame means, said first bar element having a first channel therein aligned toward said second frame means, said third support foot has an elongated second bar element for engagement with said stepping surface and transversely disposed with respect to said second frame means, said second bar element having a second channel therein aligned toward said first frame means, and said support means comprises an elongated support brace having first and second ends, said first end being slidably received by said first channel and said second end being slidably received by said second channel.

* * * * *